US006948999B2

(12) United States Patent
Chan

(10) Patent No.: US 6,948,999 B2
(45) Date of Patent: Sep. 27, 2005

(54) WAND TOY AND PROCESS

(75) Inventor: Albert Chan, Taipei (TW)

(73) Assignee: Thinking Technology Inc., Nassau (KY)

( * ) Notice: Subject to any disclaimer, the term of this patent is extended or adjusted under 35 U.S.C. 154(b) by 0 days.

(21) Appl. No.: 10/231,488

(22) Filed: Aug. 30, 2002

(65) Prior Publication Data

US 2004/0209544 A1 Oct. 21, 2004

(51) Int. Cl.[7] ..... A63H 33/22

(52) U.S. Cl. ..... 446/219; 446/242; 446/484; 40/433; 40/455; 40/900; 472/58

(58) Field of Search ..... 446/147, 149, 446/151, 152, 219, 236, 242, 266, 484, 485, 175; 40/433, 435, 455, 900; 472/58, 63

(56) References Cited

U.S. PATENT DOCUMENTS 1,516,718 A * 11/1924 Dailey ..... 352/102
2,583,510 A * 1/1952 Ingram ..... 40/364
4,072,314 A * 2/1978 Rosen et al. ..... 273/161
4,273,418 A * 6/1981 Gillespie et al. ..... 359/235
5,228,879 A * 7/1993 Fromm ..... 446/219
5,269,719 A * 12/1993 Klawitter et al. ..... 446/485
5,310,377 A * 5/1994 Joja ..... 446/219

* cited by examiner

*Primary Examiner*—Jessica Harrison
*Assistant Examiner*—Bena B. Miller

(57) ABSTRACT

A "magic mirror" wand toy has a body having a mirror element that is partially transparent. An image illuminating apparatus is mounted rearward of the mirror element. An image transport apparatus has a plurality of images that can be positioned selectively and alternately in front of the illuminating apparatus. When an image is stationary, it is lit up and an audible message associated with the image may be played. The wand can be operated in sampling mode, in which each of the set of images is displayed in sequence, and in an individual selection mode.

30 Claims, 4 Drawing Sheets

WAND TOY AND PROCESS

FIELD OF THE INVENTION

This invention relates generally to wand toys, and in particular, to wand toys having an illuminated display of the "Magic Mirror" type.

BACKGROUND OF THE INVENTION

Wand toys are a type of toy that may tend to encourage a child to exercise their imaginative and creative abilities. "Magic Mirror" wand toys are based on the archetypical magic mirror of the film "Snow White". In the insecurity inherent in the transient allure of beauty, the evil Queen is consumed by vanity. She cannot bear the thought that there may be one more fair than she. What greater symbol of her obsession than a mirror? But hers is a magic mirror that answers her queries. In her insecurity, she is driven always to ask "Who is the fairest one of all?" The image of her counsellor magically appears in the mirror, to answer her. The looking glass permits her to see far away. Thus is she inevitably shown the image of Snow White. This timeless story reaches out to the very essence of a child's imagination.

The concept of a far seeing "magic mirror" may thusly be entrancing to a child. A handheld mirror that permits one to see not only a reflection of oneself, but also of a fictional character, such as Snow White, Cinderella, or the character Belle of Beauty & the Beast, may be an attractive toy. Consequently, a number of attempts have been made to develop a wand toy that may tend to simulate a number of the properties of a magic mirror.

A common feature of several of these attempts is a wand body in the shape of a hand held mirror, with a handle at one end and a widened display face at the other. The display face includes a partially reflective and partially transparent member in which the user may view their own reflection, or, indeed, the reflection of other objects depending on the angle at which the reflective surface is held relative to the viewer seemingly as if by magic.

A further common feature of a number of earlier attempts is an illuminated image, or images, of some character or another. The image may be created by the placement of a transparency behind the partially reflective surface. A light source is mounted within the wand body behind the image. When the light source is dark, or blocked, the image is either not visible, or only very dimly visible through the partially reflective surface. However, when the light source is lit up, the image is illuminated, and the intensity of the image projected through the partially reflective member is such that the image is then visible to the viewer.

It is known also to provide an audible signal source, such as a recording of singing or dialogue, to be played when the image is illuminated. In past examples of "magic mirror" wand toy, there have been multiple images, and associated multiple light sources, each light source being associated with a particular image. It is also known to provide sequencing of the illumination of various images, and the messages played when those images are visible, to provide the suggestion of a conversation between characters.

It is further known to provide a tape recording of a set of messages. A first actuation of the wand results in the illumination of one or more images with an accompanying message, or messages. A subsequent actuation causes another message to be emitted, and so on. The roster of messages is limited, and may be provides on a fixed rotation, or may be random. The child has no control over which message is played, other than knowing which message comes "next" when the messages are presented in a fixed rotation. That is, the child cannot, typically, alter the order in which messages are presented, or choose one image rather than another.

In the magic mirror type of wand toy, when the position of the images is fixed, it tends not to be possible to project more than one image at a given location. It may be desirable to be able to manipulate the images to permit different images to be seen at the same location, perhaps with the possible effect of furthering the wonderment of the user.

The present inventor proposed that images be moved to a projection location. In creating the illusion of an image appearing at one location, followed by another image at the same location, the present inventor has addressed the timing and sequencing of movement, illumination, and sound co-ordination as described hereinbelow.

SUMMARY OF THE INVENTION

In an aspect of the invention, there is a magic mirror wand toy that is operable to illuminate more than one image at the same image illumination location. In a feature of that invention, the wand toy has a transport apparatus that carries the set of images to be displayed. The transport apparatus is movable to different positions to position different ones of the images to be displayed in front of a light source. In a further feature, the transport apparatus has indexing indicia that permit the positions of the images relative to the light projection apparatus to be known.

In another aspect of the invention there is the method, in a magic mirror wand toy, of illuminating a first image at a first viewing position, moving the first image away from the viewing position, and then illuminating a second image at a viewing position that at least partially overlaps the first viewing position. In a feature of that method, the first and second viewing positions are the same.

In another aspect of the invention, there is a mirror wand toy having a wand body having a graspable handle. The wand toy also has an at least partially reflective, partially transparent presentation member mounted to the body, the presentation member permitting a user to view the user's own reflection therein. There is a light source mounted behind the presentation member, and at least first and second translucent images. The images are substantially obscured when the light source is inoperative. An image transport apparatus is operable selectively to position a selected one of the images in a viewing position between the light source and the at least partially reflective, partially transparent presentation member. The light source is operable to illuminate the selected one of the images. There is a control apparatus connected to govern operation of the transport apparatus and the light source, and there is a user input interface selectively operable to permit a user to elect between the images.

In another feature of that aspect of the invention, the wand toy also has an audible signal emitting device connected for co-operation with the light source. In an additional feature, the audible signal emitting device has at least one message uniquely associated with the first image, and at least one message uniquely associated with the second image. In another feature, the audible signal emitting device has a first set of messages uniquely associated with the first image and a second set of messages uniquely associated with the second image.

In still another feature, the wand toy has at least a third translucent image. In an additional feature, the audible signal emitting device has a set of messages uniquely associated with each of the translucent images. In an alternate additional feature, operation of the light source is inhibited during operation of the transport apparatus.

In a further alternate feature, the transport apparatus includes a carousel driveable between at least first and second positions. In the first position the carousel places the first image in the viewing position, and, in the second position the carousel places the second image in the viewing position. In a further feature, the wand toy has a sound emitting device, the sound emitting device being operable during operation of the transport apparatus. In another feature, the transport apparatus is movable to a datum position, and is movable away from the datum position to another position to locate one of the images in the viewing position. In a still further feature, the transport apparatus includes at least one indexing member, and a sensing device is mounted to interact with the indexing member.

In another aspect of the invention, there is a mirror wand toy. It has a wand body and an at least partially reflective, partially transparent presentation member mounted to the body, the presentation member permitting a user to view the user's own reflection therein. There is a light source mounted behind the presentation member. There is a set of translucent images, and an image transport apparatus mounted to position individual integers of the set of images in a viewing position between the light source and the at least partially reflective, partially transparent presentation member. There is a control apparatus connected to govern operation of the transport apparatus and the light source. The image transport apparatus is driveable to a datum position. The transport apparatus has an indexing member. The control apparatus has a sensor co-operable with the indexing member when the image transport apparatus is in a position away from the datum position to gauge position of the image transport apparatus.

In a further feature of that aspect of the invention, the transport apparatus has a plurality of indexing members co-operable with the sensor. In an additional feature, the transport apparatus has an indexing member associated with each image of the set of images. In another feature, the transport apparatus is movable to a datum position. Then the transport apparatus is movable away from the datum position to another position, and the indexing member and the sensor are operable to permit the control apparatus to stop the transport apparatus in that other position.

In another feature, the transport apparatus is movable over a range of motion, and the indexing member permits the transport apparatus to be stopped at an intermediate position within that range of motion. In a further feature, the transport apparatus has a first end-of-motion position, and a second end-of-motion position. The transport apparatus is movable between the first and second end-of-motion positions. The transport apparatus has an intermediate position between the end-of-motion positions, and the indexing member permits the controller to determine if the transport apparatus is in the intermediate position. In still another feature, the wand toy also has at least a second indexing member for indicating when the transport apparatus is in at least one of the end-of-motion positions. In a still further feature, the wand toy has a sound emitting device, the sound emitting device being operable when the transport apparatus is in motion. In a still further feature, the light source is inhibited from illuminating any of the images while the transport apparatus is in motion.

In still another aspect of the invention there is a method of operation of a wand toy. The wand toy has a wand body; an at least partially reflective, partially transparent presentation member mounted to the body, the presentation member permitting a user to view the user's own reflection therein; a light source mounted behind the presentation member; a set of translucent images; an image transport apparatus mounted to position individual integers of the set of images in a viewing position between the light source and the at least partially reflective, partially transparent presentation member; control apparatus connected to govern operation of the transport apparatus and the light source; and the transport apparatus having an indexing member. The control apparatus includes a sensor co-operable with the indexing member. The method comprises the steps of (a) driving the image transport apparatus to a datum position; (b) driving the image transport apparatus away from the datum position; and (c) arresting the transport apparatus in a position away from the datum position in response to co-operation of the sensing means and the indexing member.

In a feature of that aspect of the invention, the method includes the step of emitting an audible signal during operation of the transport apparatus. In another feature, the method includes the step of inhibiting operation of the light source while the transport apparatus is in motion. In another feature, the method includes the step of arresting motion of at least one of the images while continuing to run a motor of the transport apparatus. In still another feature, the method includes the steps of (d) waiting for a signal from the user input interface; (e) receiving a signal from the user input interface; and (f) operating the transport apparatus to present a selected one of the images in response to the signal from the user input interface.

In another feature of that aspect of the invention, the method includes providing a plurality of input keys for the user input interface, and uniquely associating each of the keys with one of the images. In a further feature, the method includes the step of waiting in an active mode for a new user input signal; waiting in a dormant mode after expiry of a waiting period; receiving a new user input signal while in the dormant mode; and returning the transport apparatus to the datum position after receiving the new user input signal. In a still further feature, there is the step of sequentially illuminating each image of the set of images. In another feature, the method includes the step of receiving a new user input signal from the user input interface and illuminating a selected one of the images according to the new user input signal. In still another feature, the method includes the step of moving at least one of the images past the viewing position without illuminating that image.

DETAILED DESCRIPTION OF THE PREFERRED EMBODIMENT

Figure 1:
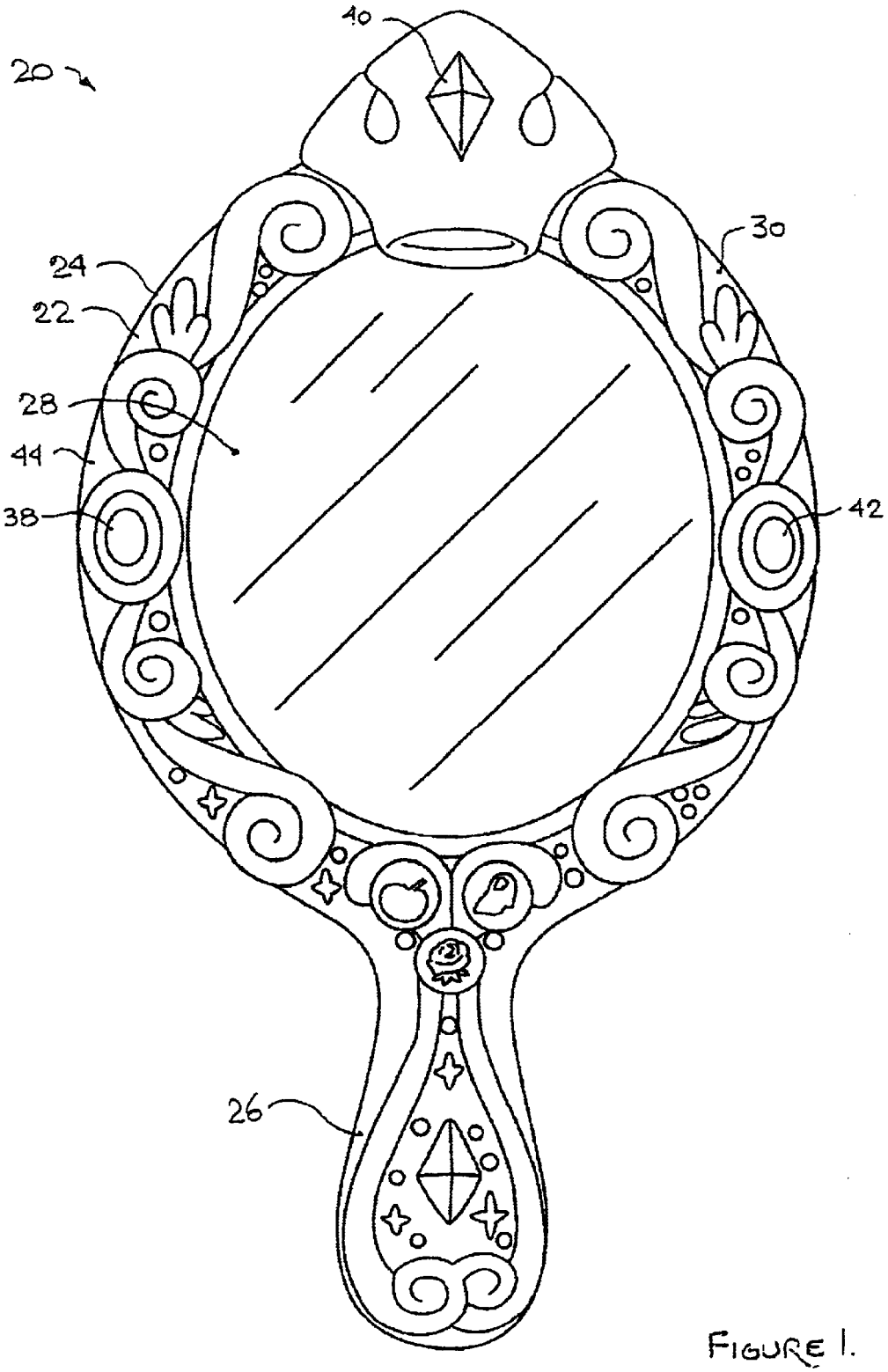
FIG. 1 shows a plan view of a general arrangement of a wand toy according to the present invention.

The description that follows, and the embodiments described therein, are provided by way of illustration of an example, or examples, of particular embodiments of the principles of the present invention. These examples are provided for the purposes of explanation, and not of limitation, of those principles and of the invention. In the description that follows, like parts are marked throughout the specification and the drawings with the same respective reference numerals. The drawings are not necessarily to scale and in some instances proportions may have been exaggerated in order more clearly to depict certain features of the invention.

The following description pertains to a wand toy. In the context of that description, the long axis of the wand toy runs centrally from the most distal extremity of the wand handle through to the extremity of the housing lying most distant from the handle. The terms front and frontward, back, backward, rear and rearward used in the context of location and orientation of several items are taken with reference to a mirror simulating visual display interface. When the wand is held in a user's hand, such as for providing the user with a view of their own reflection, the user is in front of the plane of the visual display interface. By contrast, the inner workings of the wand toy are behind, or rearward of the plane of the visual display interface.

Commencing with FIG. 1, an example of an embodiment of a "magic mirror" wand toy according to an aspect of the present invention is identified generally as 20. The wand toy has a wand body 22 that has a first, main, or major portion 24 that is generally elliptically shaped, and a second, or lower portion formed in the shape of a graspable handle 26 having a relatively narrow root joining the main portion of body 22, and a relatively wider, somewhat bulbous distal portion lying beyond the waist. A partially reflective, partially transparent presentation interface member 28 is mounted to body 22. Presentation interface member 28 permits a user to view the user's own reflection therein and may generally be referred to as the "mirror" portion of the wand. Thus, in general appearance wand toy 20 is similar to a hand held looking glass, such as might be found on a woman's dressing table with a brush and comb.

Body 22 is formed from a frontshell member 30 and a backshell member 32, each being formed as a monolithic molded member, the two being formed to mate as female and male parts with corresponding studs 34 and sockets that align to admit the joining of the front and backshell members by threaded mechanical fasteners in the nature of Phillips screws 35 of various lengths, as may be suitable, screws 35 being admitted from the backside through the recessed sockets provided therefore in backshell member 32.

As befits a magic mirror, the front shell member 30 has suitable adornments and flourishes, in the nature of jewel shaped members 38, 40, and 42 at the 9 o'clock, 12 o'clock, and 3 o'clock positions relative to the mirror face, i.e., the presentation interface each jewel shaped member having a coloured transparent lens, or cover, and fausse rosettes and curliqueues arrayed about the margin defined by the surround, or bezel 44, that lies peripherally about the partially transparent presentation interface member 28.

Figure 3:
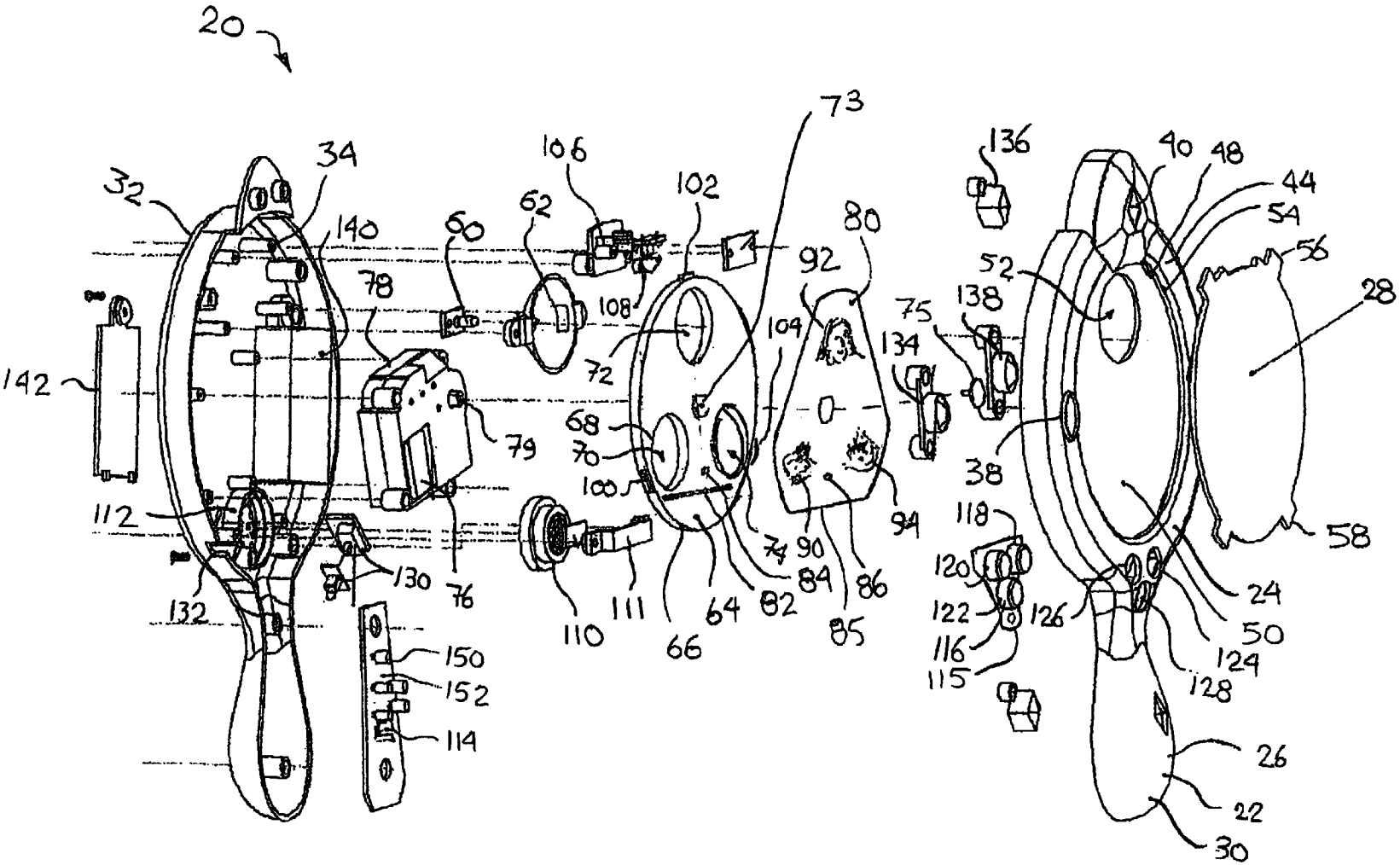
FIG. 3 shows an exploded view of the wand toy of FIG. 1.

As shown in FIG. 3, an integrally molded, generally planar recessed web 50 extends across the generally elliptical expanse lying within the boundary formed by bezel 44. Web 50 forms an opaque backplate for the partially transparent presentation interface member 28. A projection port 52 is defined in the central, upper, generally 12 o'clock region of web 50. Projection port 52 may have a periphery cut to such profile as may be desired, whether an arbitrary shape, whether regular or irregular, whether arcuate, polygonal, partially arcuate, a star shape, a diamond, rectangle, a moon, an oval, an ellipse or some other shape. In the preferred embodiment, projection port 52 is generally circular. A peripheral shoulder 54 is formed between web 50 and bezel 44. Shoulder 54 has locating slots 48 defined therein for receiving tabs 56, 58 of interface member 28.

Also shown in FIG. 3 is a light source 60, in the nature of a light bulb mounted in a reflector 62 mounted on studs in backshell 32. Light source 60 and reflector 62 are oriented to co-operate in the illumination of objects lying forwardly thereof, and are placed in direct alignment with projection port 52. An image transport apparatus is indicated as 64. Image transport apparatus 64 has the general appearance of a circular carousel 66 with a plurality of projection windows 68 defined therein, (in this example three windows identified as 70, 72 and 74, but being more generally representative of any number of windows, being at least first and second windows, and up to as many as can be comfortably accommodated within the area of the transport carousel), equipped with a drive train in the nature of a motor 76, and a gearbox 78 driven by motor 76. The output shaft 79 of gearbox 78 is keyed by means of a flat portion on one side, to a mating keyed socket 73 protruding from the underside of carousel 66 such that torque can be transmitted from output shaft 79 to carousel 66. An interference-fit retainer plug 75 holds carousel 66 on shaft 79. Motor 76 and gearbox 78 are linked to a disengageable internal clutch, such that motor 76 can turn without always imparting motion to carousel 66.

A monolithic image sheet 80 is mounted to the frontwardly facing surface of carousel 66. Carousel 66 has a raised ridge, or wall 82 running chordwise across it, and an upstanding registration stub 84. Image sheet 80 has a perforation 86 that picks up on stub 84, with the base edge 85 of image sheet 80 aligned with wall 82 and fixed in place by adhesive means, such as adhesive tape, thereby positively locating images 90, 92, and 94 with respect to windows 70, 72 and 74 respectively. In this example, images 90, 92 and 94 may depict, for example, Cinderella, Snow White, and Belle, respectively, although other characters, whether real or fictional, and may include animals, fictional or extinct beasts, space aliens, phantoms, or cartoon characters, could be chosen. These images are all at least partially translucent such that, in normal inside room lighting, when light source 60 is illuminated, the projection of which ever of those images is located at (i.e., athwart of) projection port 52 can be seen through partially transparent interface member 28.

When light source 60 is inoperative (i.e., the light is turned off), the partial transparency of member 28 is sufficiently poor that the image opposite the projection port is substantially obscured. The images behind web 50 are fully hidden from view.

Image transport apparatus 64 includes position indexing members, in the nature of protrusions, or radially outwardly extending cam members 100, 102, 104 mounted peripherally thereabout, each of protrusions 100, 102 and 104 being associated with, by being placed adjacent to, windows 70, 72 and 74 respectively.

A sensing means in the nature of spring loaded microswitch 106 is mounted in the 12 o-clock position relative to carousel 66 such that a resiliently biased member in the nature of a spring loaded foot, or cam follower 108 is biased to ride on the outside peripheral edge of carrousel 66. Switch 106 is activated each time one of protrusions 100, 102, or 104 engages cam follower 108. Consequently there is a sensing means, or sensor, namely microswitch 106, that is co-operable with indexing members, namely protrusions 100, 102, 104 to gauge the position of carousel 66. Other means, such as a magnetic capacitive, or photoelectric sensor could also be used. This cam follower could be located elsewhere within the enclosure defined by backshell 32 and front shell 30, provided that protrusions 100, 102 and 104 bear the same geometric and functional relationship to it and to the images with which they are associated. That is, when image 90 is aligned with projection port 52, protrusion 100 engages cam follower 108; when image 92 is aligned with port 52, protrusion 102 engages cam follower 108; and when image 94 is aligned with port 52 protrusion 104 engages cam follower 108.

A number of other electrical components are mounted within body 22. First, an audible signal-emitting device, in the nature of a speaker 110 is mounted in a receptacle 112 in backshell member 32 and held in place by retainer bracket 111. A message storage element 114, whether a tape unit, or, more contemporaneously, and preferably, a digital voice synthesis device and digital memory storage element is connected to drive speaker 110. The base of receptacle 112 is perforated with a pattern of holes to facilitate projection of sound from the backside of body 20. In the preferred embodiment of the invention, the digital voice synthesis and storage apparatus includes a first set of recorded messages associated with the first visual image 90, a second set of recorded messages associated with the second visual image 92, and a third set of messages associated with the third image 94 and storage elements 114 is incorporated in an electrical microprocessor control, namely electrical signal processing apparatus 150 discussed below.

Response selection apparatus 116, in the nature of an array of individually selectable keys identified as keypads 118, 120, and 122, is mounted on a common pc wiring board base 115, base 115 having a profile to mount within front shell 30 at the root of handle 26, such that keypads 118, 120 and 122 protrude through apertures 124, 126 and 128, respectively, formed in frontshell member 30. When thusly located a user may selectively choose between keypads 118, 120 and 122 to obtain a desired choice of image. The keypads are placed at the root of handle 26 may tried to be operable with the thumb of the hand with which wand 20 is held, but can also be operated with two hands. In the embodiment shown, each of keypads 118, 120 and 122 is both colour coded (for example, blue, red and yellow respectively) and provided with an individual molded icon (for example, a glass slipper, an apple, and a rose, respectively) that can be distinguished both visually and by touch from the others, each icon being uniquely associated with a specific one of the images to be illuminated.

Figure 2:
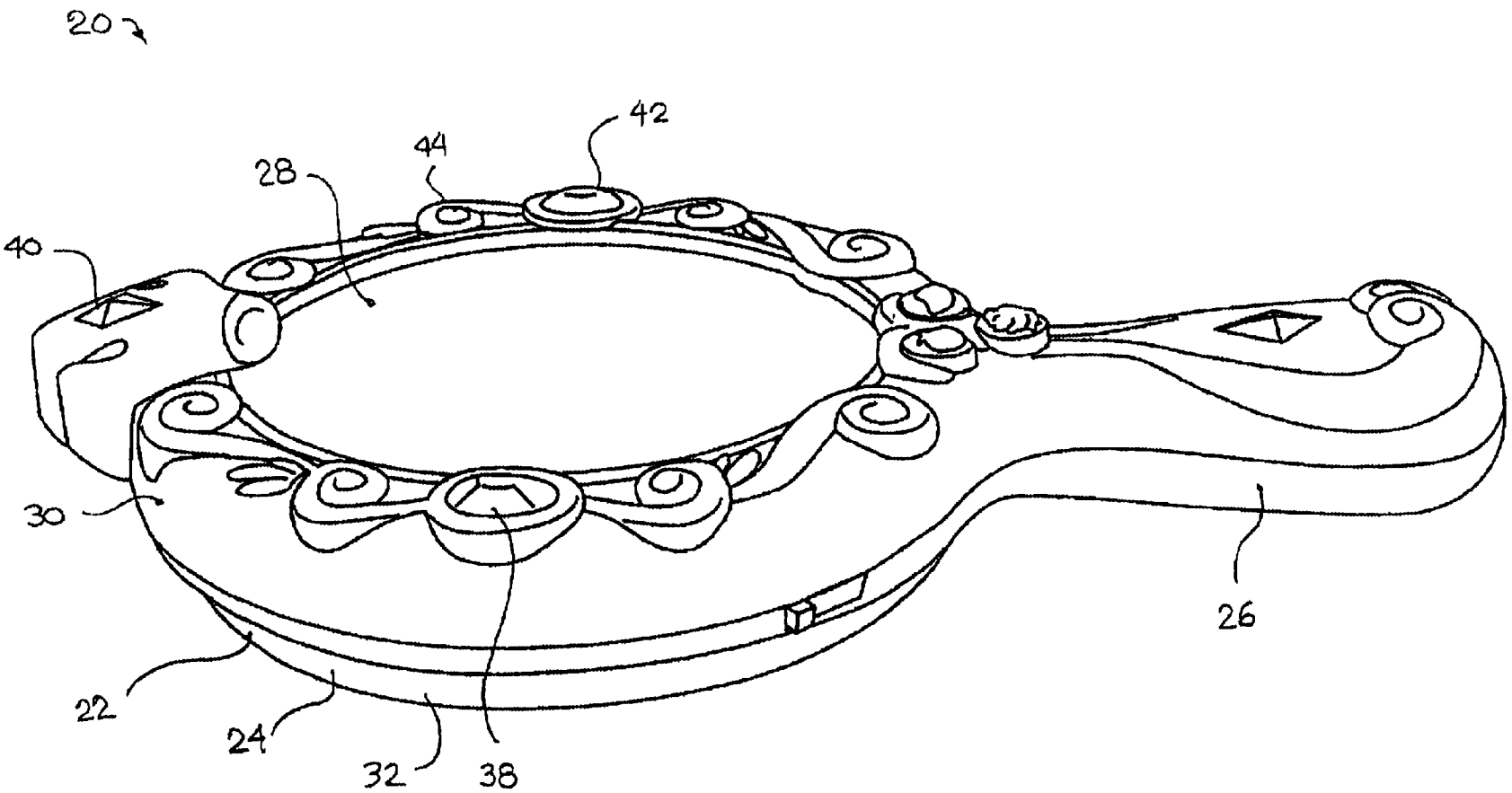
FIG. 2 shows a three-quarter view from the side of the wand toy of FIG. 1.

A master switch 130, also visible in FIG. 2, is mounted in a socket 132 in backshell 32 located at roughly a 7 or 8 o'clock position relative to the face of the partially transparent interface member. Master switch 130 is a three position switch movable between "Off", "Play", and "Try me" positions, as explained below.

A set of three lights in the nature of LED's 134, 136, and 138 are each mounted within the bezel portion of front shell 30 at the 3, 6 and 9 o'clock positions respectively, and are used to illuminate the simulated jewel shaped members 38, 40 and 42. These lights may be operated in a flashing manner, or in a non-flashing, steady manner. They may be different colours, whether red, blue, yellow, green, or some other colour, and there may be more or less than 3 lights. It is not necessary that the wand toy have bezel lights, but, in the preferred embodiment there are three such LED's and they flash in an alternating manner.

A generally rectangular inwardly extending battery pack housing recess 140 is integrally molded into backshell member 32, and accommodates a pair of dry cell batteries, preferably rechargeable AA 1.5 V batteries mounted in series. A cover 142 secures the batteries in place.

Figure 4:
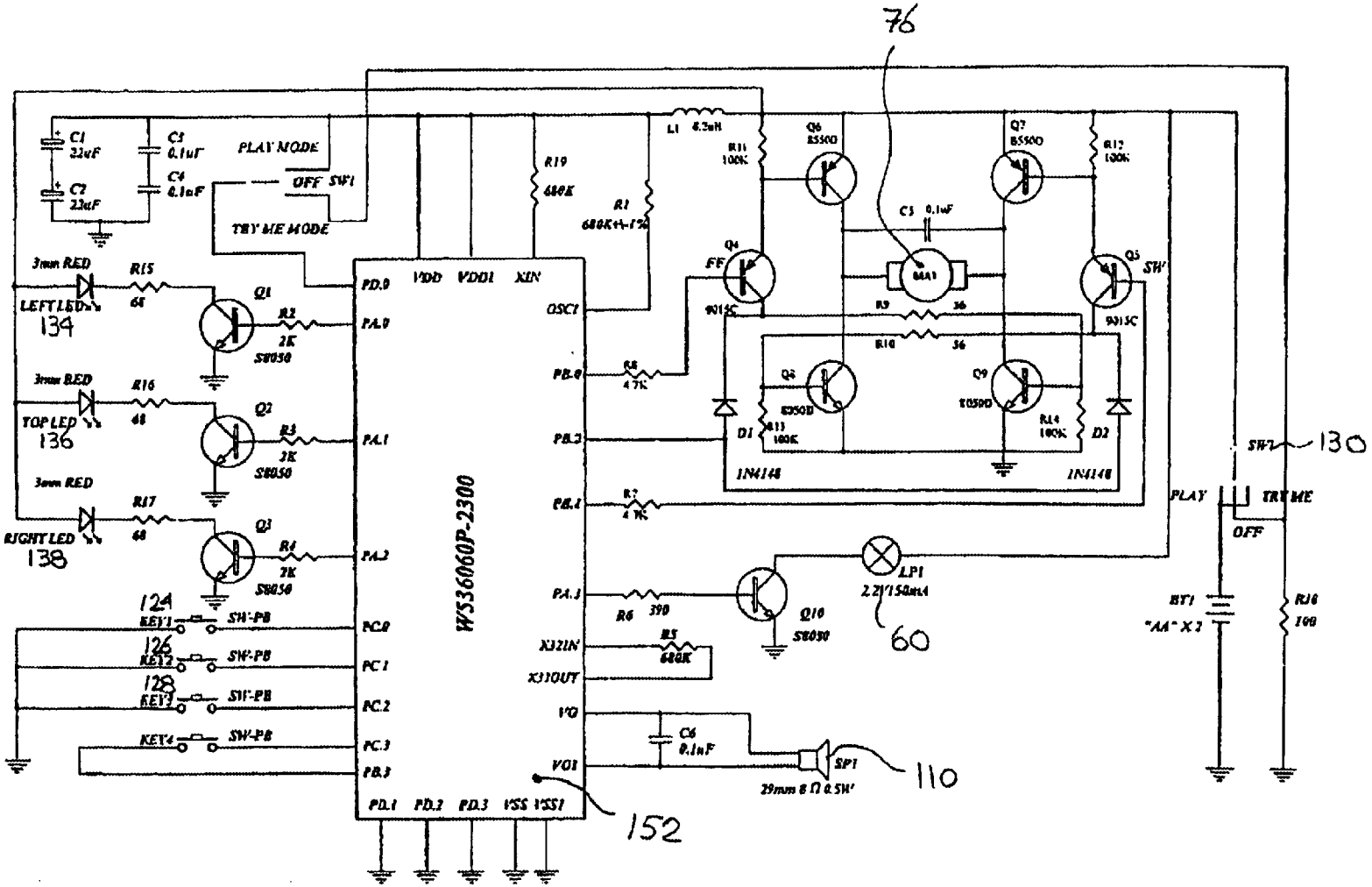
FIG. 4 shows a wiring diagram for the wand toy of FIG. 1.

Control of the electrical components thus far enumerated is co-ordinated by an electrical signal processing apparatus 150 in the nature of a microprocessor 152 whose circuit board is shaped to fit within, and which is mounted within the hollow in handle portion 24 of body 20. A circuit diagram for wand 20 is provided in FIG. 4, which shows the electrical interconnection of the various components enumerated above. For the sake of clarity, wires and wiring harness are omitted from FIG. 3. Electrical signal processing apparatus 150 is activated by master switch 130. It then responds to inputs from (a) user controlled signals input from any of the three keypads 118, 120, 122 in the keypad array; and (b) indexing counter signals from microswitch 106. The response to these inputs controls (a) the operation of motor 76, including the internal clutch of the motor and gearbox module; (b) light source 60; (c) speaker 110; (d) and the flashing of LED's 134, 136 and 138. Power to all of these components is provided by the batteries.

It will be understood that a user interface array may have more, or fewer, than three keypads, and yet still permit a user to select among options. For example, options may be selected by a pattern of activation of one or more keypads, like a code, or combination, of keystrokes to activate a selected response. The user interface may have a keyboard permitting the names of the characters to be spelt out, or identified by a number code. Alternatively, multi-position switches that can be selected in a multiplicity of directions according to the desired output, such as a switch operable in +x, −x. +y, and −y to permit four choices, or a track-ball, or track balls could be used.

All of these functions are disabled in "Off" mode, and the magic wand is then inoperative.

When master switch 130 is moved to "Play" mode, the processor awaits further inputs from the keypads. The first touch of any of key pads 118, 120 or 122 will cause the apparatus to operate in "sample mode", namely to provide a sample of each of the available selections, in sequence as described below. Thereafter a touch to any of keypads 118, 120, 122 will cause the image associated with that particular keypad to be moved into alignment with light source 60 (and hence projection port 52) and illuminated at the selection of the user. In the event that no key is pressed for a relatively lengthy period of time (2 minutes, roughly) the processor may revert to a dormant mode, and, when re-activated by the next keystroke, may re-commence with the sampling mode.

When master switch 130 is moved to "Try Me" mode, wand 20 will automatically present the sampling of displayed images as in "sample mode", without the need to activate the processor by a keystroke. Thereafter a keystroke will cause the display to move to the selected image, and to illuminate. As the image is illuminated, an audible message associated with that image may preferably be emitted.

Operation of the Transport Apparatus

The first operation of wand 20 after the master switch is moved from the "Off" position, or the first operation after a long inactive period is to operate in sampling mode. It is desirable for the processor (i.e., microprocessor 152) to establish the location of carousel 66. To that end, activation, whether by a keystroke or by activating "Try Me" mode causes control apparatus 150 to apply power to motor 76 to drive carousel 66 to a fully clockwise position. Once carousel 66 reaches that position, (in which cam 100 displaces cam follower 108 to activate microswitch 106 with the first image aligned with light source 60), the drive for motor 76 is disengaged from the output shaft of gearbox 78, effectively yielding an end-of-stroke clockwise stop position. This fully clockwise, end-of-motion position provides a datum position for subsequent operation. Carousel 66 remains in position while motor 76 finishes running with the internal clutch disengaged. Control apparatus 150 is programmed to operate motor 76 for sufficiently long that, whatever the position carousel 66 may previously have been, motor 76 has time to move carousel 66 from its most anti-clockwise position to its most clockwise position, with reasonable allowance for a low battery (i.e., a batter that is nearly discharged). In the preferred embodiment this running time period may be about 5 seconds.

During the time that motor 76 is in operation, lights LED's 134, 136 and 138 may flash on and off, with the 12 o'clock light 136 alternating with the two lights 134, 138 at the 3 and 9 o'clock locations. At the same time an audio signal may be emitted, such as, for example, a swirling harp, or harp-like sound such as one may associate with the invocation of a magic spell, and such as is sometimes heard in film or on television. The flashing of lights and the swirling magic sound may cease when motor 76 stops. In an alternate embodiment, the swirling magical sounds may continue after operation of motor 76 ceases. When motor 76 has stopped, there may be brief time delay (a few milliseconds, perhaps). Then, with the images stationary, power is admitted by control apparatus 150 to light source 60, causing it to illuminate the image aligned with projection port 52. Alternatively, there may not be any time delay between the cessation of operation of motor 76 and the commencement of illumination of the image. In the first portion of "sampling mode" this image is the first image. In a preferred embodiment, an audible signal emitter, namely speaker 110, may then be activated to emit a voice message, or song, while the flashing lights, namely LED's 134, 136, 138 are turned off.

In sampling mode, when the first audible message is finished, light source 60 is turned off, such that the illuminated image "disappears", or seemingly so. Once the image is extinguished, motor 76 is re-activated, with the output shaft of the gearbox driving carousel 66 in the other direction (i.e., counter-clockwise) to drive carousel 66 away from the fully clockwise datum position. In this instance the controller knows that it is moving away from the first or datum position (namely, the position of carousel 66 in which the first of the images is exposed) and toward the second position (namely, the position of carousel 66 in which the second image is exposed). As such, when cam follower 108 meets cam 102, control apparatus 150 senses the change of state in microswitch 106 and causes operation of motor 76 to cease, thereby arresting carousel 66 in a position away from the datum position. During the period of motion, LED's 134, 136, 138 may flash as before, accompanied, as before, by the swirling magical sound emitted from speaker 110, which may tend to mask, or drown out, the sound of motor 76. When motor 76 ceases to operate, the swirling sound finishes its cycle, and the flashing bezel lights (LED's 134, 136, 138) cease to flash.

When the second image is stationary, and lying aligned between light source 60 and projection port 52, control apparatus 150 causes light source 60 to illuminate second image 92. It is preferred that an audible message associated with second image 92 then also be emitted by speaker 110. Once this message is complete, light source 60 may again be extinguished. Once extinguished and the second image 92 again seemingly "invisible", the steps may repeat. That is, motor 76 is again activated, preferably accompanied by flashing bezel lights and swirling audio effects, as before. In this instance motor 76 runs until protrusion 104 engages cam follower 108, again causing a change of state in microswitch 106 sensed by control apparatus 150. This disengages motor 76 from the gearbox output shaft, causing carousel 66 to stop, in effect yielding a fully counter-clockwise end-of-motion stop. Motor 76 then stops, the bezel lights may stop flashing, and the swirling magic sound may cease. It will be noted that carousel 66 may not be able to turn through full revolutions, but may be limited to a range of motion according to the angular displacement defined between the full clockwise and full counter-clockwise end-of motion stop positions.

At this point, the third image, namely image 94, lies stationary and in alignment with light source 60 and projection port 52. Light source 60 is activated to illuminate the third image, and, preferably, an audible message associated with the third image is emitted by speaker 110. In the event that a greater number of images is employed, this process may repeat until such time as the full array has been sampled.

When the sampling mode cycle is complete, wand 20 remains activated. Processor 152 retains a memory of the location of carousel 66. A user may then select one of key pads 118, 120, 122, causing a particular image to be selected.

If the last previous image is adjacent to the next chosen image, then motor 76 is activated to move carousel 66 in the appropriate direction, whether clockwise or counter-clockwise, and the process repeats much as before, with the usual accompaniment of swirling magical sounds and flashing lights that occurs each time motor 76 is in operation. When microswitch 106 is activated, the motor is stopped, and the selected image is illuminated, preferably with an associated audible message. In the preferred embodiment, the audible message is the next message in a set of messages associated with the particular selected image. (When the system operates in "sample mode", as when initially activated, as when activated by resetting of master switch 130 in "Try me" position, or when re-activated after a lengthy period of inaction, the selection of audible messages may be reset to the first message in each of the sets associated with each of the characters). Where the same image is selected over and over, there is no motion of carousel 66, but rather merely an emission of the next audible message in the set, or roster, of messages associated with that image. When the set of messages is exhausted, the roster may roll over again to the initial message, and so on.

If the last previous image is not adjacent to the next chosen image, the controller counts the number of times microswitch 106 is activated, and stops carousel 66 after the appropriate number of pitches have been traversed. In the example, if the selected image is two images away from the image at which the carousel previously stopped, the controller will count 2 activations of microswitch 106 before stopping carousel 66 on the second activation. It will do this in either the clockwise or counter-clockwise directions.

It should be noted that, in a preferred embodiment, if a subsequent keystroke is made while the apparatus is engaged in illuminating one image, and possibly while an audible message associated with that image is in progress, that keystroke is ignored by control apparatus 150. That is, control apparatus 150 will not interrupt execution of a previously commenced activity, and will ignore all subsequent keystrokes until the previous activity is complete. In an alternate embodiment a keystroke, or combination of keystrokes, may be used to interrupt execution of a previous command or selection.

In each case, light source 60 may be activated as a step function, from "off" to full voltage. Alternatively, light source 60 may be activated slowly to cause the image to glimmer softly at first, at a first, or rising, level of intensity, and then to increase to full intensity, to simulate a magic image clarifying itself. In a further alternative, the light intensity can fluctuate to yield a wavering image.

Although a transport mechanism in the nature of circular carousel 66 has been illustrated and describes, a non-circular mechanism could be used, such as an arc of a circle, or a linear rack. A circular carousel, as described, is preferred. Further, the embodiment described above makes reference to clockwise operation followed by counter-clockwise operation, as, for example, in the sampling mode. It will be understood that the directional operation could be reversed. For example, the datum position could by the fully counter-clockwise position, and counter-clockwise motion could then be followed by clockwise motion.

Projection port 52 may be larger than whichever of the images may be chosen to be illuminated therethrough. It may also be that one image may be stopped more to one side of projection port 52 than another. In that case, it may be said that the first image is stopped in a first viewing position relative to projection port 52, while the second image is stopped in a different, second position relative to projection port 52. The first and second positions are each visible through projection port 52, and may tend to overlap, at least in part. It is preferred that the first and second positions overlap to a great extent such that the first and second positions may, in the most preferred embodiment, be the same position.

The foregoing description pertains to wand toys generally. A wand toy may have the general shape of a hand held looking glass, but may also have the shape of a magic wand, with, for example, a star shaped end that lights up and presents images as described above. It may also take the form of a crystal ball, or palantir, or a hand held console, whether with a single handgrip or a pair of handgrips, such as might simulate the controls of a jet fighter or rocket fighter, with a central display.

Various embodiments of the invention have now been described in detail. Since changes in and or additions to the above-described best mode may be made without departing from the nature, spirit or scope of the invention, the invention is not to be limited to those details, but only by the appended claims.

PARTS LIST

Wand toy—20
Wand Body—22
Major portion (of 22)—24
Graspable handle—26
Presentation interface member—28
Frontshell—30
Backshell—32
Studs—34
Jewel shaped member (9 o'clock)—38
Jewel Shaped Member (12 o'clock)—40
Jewel Shaped Member (3 o'clock)—42
Bezel—44
Blank—46
Locating Slots—48
Web—50
Projection Port—52
Peripheral shoulder—54
Tab (of mirror)—56
Tab (of mirror)—58
Light Source—60
Reflector—62
Image Transport Apparatus—64
Carousel—66
Projection Windows—68
First Window—70
Second Window—72
Keyed Socket—73
Third Window—74
Interference—fit retainer plug 75
Motor—76
Gearbox—78
Gearbox output shaft 79
Image sheet—80
wall—82
registration stub—84
perforation—86
Blank—88
Image No. 1 Cinderella—90
Image No. 2 Snow White—92
Image No. 3 Belle—94
Blank—96
Blank—98
Cam Member No. 1—100
Cam Member No. 2—102
Cam Member No. 3—104
Micro-switch—106
Cam Follower—108
Speaker—110
Receptacle—112
Message Storage Element—114
Keypad wiring board base—115
Response selection apparatus—116
Keypad No. 1—118
Keypad No. 2—120
Keypad No. 3—122
Aperture No. 1—124
Aperture No. 2—126
Aperture No. 3—128
Master switch—130
Socket—132
LED No. 1—134
LED No. 2—136
LED No. 3—138
Recess—140
Cover—142
Batteries—144
Blank—146
Blank—148
Electrical Signal Processing Apparatus—150
Microprocessor—152

I claim:

1. A mirror wand toy comprising:

a wand body having a graspable handle;

an at least partially reflective, partially transparent presentation member mounted to said body, said presentation member permitting a user to view the user's own reflection therein;

a light source mounted behind said presentation member;

at least first and second translucent images;

said images being substantially obscured when said light source is inoperative;

an image transport apparatus operable selectively to position a selected one of said images in a viewing position between said light source and said at least partially reflective, partially transparent presentation member;

said light source being operable to illuminate said selected one of said images;

control apparatus connected to govern operation of said transport apparatus and said light source; and a user input interface selectively operable to permit a user to elect between said images.

2. The mirror wand toy of claim 1 further comprising an audible signal emitting device connected for co-operation with said light source.

3. The mirror wand toy of claim 2 wherein said audible signal emitting device has at least one message uniquely associated with said first image, and at least one message uniquely associated with said second image.

4. The mirror wand toy of claim 2 wherein said audible signal emitting device has a first set of messages uniquely associated with said first image and a second set of messages uniquely associated with said second image.

5. The mirror wand toy of claim 2 wherein said toy has at least a third translucent image.

6. The mirror wand toy of claim 5 wherein said audible signal emitting device has a set of messages uniquely associated with each of said translucent images.

7. The mirror wand toy of claim 1 wherein operation of said light source is inhibited during operation of said transport apparatus.

8. The apparatus of claim 1 wherein said transport apparatus includes a carousel driveable between at least first and second positions, in said first position said carousel placing said first image in said viewing position, and, in said second position said carousel placing said second image in said viewing position.

9. The apparatus of claim 1 further comprising a sound emitting device, said sound emitting device being operable during operation of said transport apparatus.

10. The apparatus of claim 1 wherein said transport apparatus is movable to a datum position, and is movable away from said datum position to another position to locate one of said images in said viewing position.

11. The apparatus of claim 1 wherein said transport apparatus includes at least one indexing member, and a sensing device is mounted to interact with said indexing member.

12. A mirror wand toy comprising:

a wand body;

an at least partially reflective, partially transparent presentation member mounted to said body, said presentation member permitting a user to view the user's own reflection therein;

a light source mounted behind said presentation member;

a set of translucent images;

an image transport apparatus mounted to position individual integers of said set of images in a viewing position between said light source and said at least partially reflective, partially transparent presentation member;

control apparatus connected to govern operation of said transport apparatus and said light source; and said image transport apparatus being driveable to a datum position;

said transport apparatus having an indexing member;

said control apparatus having a sensor co-operable with said indexing member when said image transport apparatus is in a position away from said datum position to gauge position of said image transport apparatus.

13. The mirror wand toy of claim 12 wherein said transport apparatus has a plurality of indexing members co-operable with said sensor.

14. The mirror wand toy of claim 13 wherein said transport apparatus has an indexing member associated with each image of said set of images.

15. The mirror wand toy of claim 12 wherein:

said transport apparatus is movable to a datum position;

said transport apparatus is movable away from said datum position to another position;

and, said indexing member and said sensor are operable to permit said control apparatus to stop said transport apparatus in that other position.

16. The mirror wand toy of claim 12 wherein:

said transport apparatus is movable over a range of motion; and said indexing member permits said transport apparatus to be stopped at an intermediate position within that range of motion.

17. The mirror wand toy of claim 12 wherein:

said transport apparatus has a first end-of-motion position, and a second end-of-motion position;

said transport apparatus is movable between said first and second end-of-motion positions;

said transport apparatus has an intermediate position between said end-of-motion positions;

and said indexing member permits said controller to determine if said transport apparatus is in said intermediate position.

18. The mirror wand toy of claim 17 further comprising at least a second indexing member for indicating when said transport apparatus is in at least one of said end-of-motion positions.

19. The mirror wand toy of claim 12 further comprising a sound emitting device, said sound emitting device being operable when said transport apparatus is in motion.

20. The mirror wand toy of claim 12 wherein said light source is inhibited from illuminating any of said images while said transport apparatus is in motion.

21. A method of operation of a wand toy, the wand toy having a wand body;

an at least partially reflective, partially transparent presentation member mounted to said body, said presentation member permitting a user to view the user's own reflection therein;

a light source mounted behind said presentation member;

a set of translucent images;

an image transport apparatus mounted to position individual integers of said set of images in a viewing position between said light source and said at least partially reflective, partially transparent presentation member;

control apparatus connected to govern-operation of said transport apparatus and said light source; and said transport apparatus having an indexing member;

said control apparatus including a sensor co-operable with said indexing member, said method comprising the steps of:

driving said image transport apparatus to a datum position;

driving said image transport apparatus away from said datum position; and arresting said transport apparatus in a position away from said datum position in response to co-operation of said sensing means and said indexing member.

22. The method of claim 21, further comprising the step of emitting an audible signal during operation of said transport apparatus.

23. The method of claim 21 further comprising the step of inhibiting operation of said light source while said transport apparatus is in motion.

24. The method of claim 21 further comprising the step of arresting motion of at least one of said images while continuing to run a motor of the transport apparatus.

25. The method of claim 21 further comprising the steps of:

waiting for a signal from said user input interface;

receiving a signal from said user input interface; and operating said transport apparatus to present a selected one of said images in response to said signal from said user input interface.

26. The method of claim 21 further comprising:

providing a plurality of input keys for said user input interface; and uniquely associating each of said keys with one of said images.

27. The method of claim 21 further comprising the step of waiting in an active mode for a new user input signal;

waiting in a dormant mode after expiry of a waiting period;

receiving a new user input signal while in said dormant mode; and returning said transport apparatus to said datum position after receiving said new user input signal.

28. The method of claim 27 further comprising the step of sequentially illuminating each image of said set of images.

29. The method of operation of claim 21 including the step of receiving a new user input signal from said user input interface and illuminating a selected one of said images according to said new user input signal.

30. The method of claim 21 including the step of moving at least one of said images past said viewing position without illuminating that image.

* * * * *